US005088950A

United States Patent [19]

LaFata

[11] Patent Number: 5,088,950

[45] Date of Patent: Feb. 18, 1992

[54] HIGH FLUID CAPACITY BRUSHES AND BUBBLE BLOWING SYSTEM

[75] Inventor: John E. LaFata, Oxnard, Calif.

[73] Assignee: Toy Orginators, Inc., Oxnard, Calif.

[21] Appl. No.: 522,742

[22] Filed: May 14, 1990

[51] Int. Cl.[5] ..... A63H 33/28; A46B 11/00

[52] U.S. Cl. ..... 446/19; 446/15; 15/168

[58] Field of Search ..... 446/15, 16, 17, 18, 446/19, 20, 21; 15/168, 169, 159 A

[56] References Cited

U.S. PATENT DOCUMENTS

| | | | |
|---|---|---|---|
| 237,579 | 2/1881 | Musselman | 15/168 |
| 1,684,358 | 9/1928 | Mosquera | 15/168 X |
| 3,256,545 | 6/1966 | Lenis, Jr. et al. | 15/159 A |
| 3,312,994 | 4/1967 | Fassio | 15/159 A |
| 3,344,457 | 10/1967 | Grobert | 15/159 A |
| 3,383,276 | 5/1968 | Gould | 15/159 A X |
| 4,770,649 | 9/1988 | Cuccio | 446/15 |

FOREIGN PATENT DOCUMENTS 2817714 10/1979 Fed. Rep. of Germany ..... 15/168

*Primary Examiner*—David N. Muir

*Attorney, Agent, or Firm*—Cassidy, Vance & Tarleton

[57] ABSTRACT

A brush-type system for attracting high volumes of fluid through capillary action and retaining such fluid by surface tension pending usage; and, more particularly, a brush-type system (20) of the foregoing type for blowing bubbles including: a hollow tubular body member (21); a plurality of flexible bristles (22) disposed in a hollow tubular array (24) and secured in coaxial end-to-end relation to the body member (21) and in closely spaced surrounding relation to the tubular array (24) of bristles (22) with the free ends of the bristles (22) projecting slightly beyond the free end of the sleeve (25). The bristles (22) are preferably slightly sinuous and have longitudinally extending radial flutes (30). The bubble blowing system (40) preferably includes an essentially spill-proof receptacle (41) for receiving the brush (20) and enabling loading of the bristles (22) with a bubble forming solution without risk of deformation of the bristles (22).

3 Claims, 1 Drawing Sheet

HIGH FLUID CAPACITY BRUSHES AND BUBBLE BLOWING SYSTEM

RELATED PATENT

The present invention, in its more specific aspects, comprises an improvement on the brush-type soap gathering and bubble blowing device disclosed and claimed in U.S. Pat. No. 4,770,649, issued on Sept. 13, 1988, to John D. Cuccio.

BACKGROUND OF THE INVENTION

A. Technical Field

The present invention relates generally to brush-type systems for attracting and retaining high volumes of fluid for subsequent usage; and, more particularly, to such a system including: i) a base member; ii) a plurality of closely spaced, generally parallel, flexible bristles secured to and extending from the base member; and at least one, and preferably both, of iii), a hollow tubular sleeve surrounding and closely spaced from the plurality of bristles, with one end of the sleeve affixed to the base member and the opposite end of the sleeve terminating short of the free ends of the bristles so that the free ends of the bristles project slightly beyond the free open end of the sleeve: and/or iv), a plurality of longitudinally extending, radial flutes formed on each bristle for increasing the surface area thereof and the volume of space between adjacent bristles, whereby when the bristles are inserted into a fluid body, fluid is attracted by capillary action and is retained between the bristles in the regions of the radial flutes when provided, and/or in the annular space between the inner surface of the sleeve, when provided, and the bristles most proximate thereto, thereby maximizing the quantity of fluid that can be attracted by capillary action and retained by surface tension for subsequent usage. The present invention finds particularly advantageous use when employed in a bubble blowing system wherein the base member and bristles are disposed in a hollow tubular configuration of any desired cross sectional shape and are disposed in end-to-end relation with the sleeve surrounding all but the free projecting bristle ends, thereby permitting the user to grasp the base member and project an airstream through the hollow aligned base member and tubular array of bristles—for example, by blowing therethrough—so as to separate a film of bubble blowing solution adhering to the bristles from the bristles and thereby project bubbles from the free projecting bristle ends, which bubbles can be separated from the device either by blowing or movement of the device through the ambient atmosphere. In one specific form of bubble blowing system embodying the present invention, an essentially spillproof container or reservoir for a fluid body—such, for example, as a bubble blowing solution—is provided so as to preclude inadvertent accidental spillage of the fluid, particularly when used by children.

B. Background Art

There has been, for many years, a demand for a wide variety of bubble blowing devices and/or toys ranging, for example, from simple rings to suspend a film of soapy solution which can be separated from the ring by a moving airstream, to complex bubble blowing guns and/or similar toys and devices employing, for example, aerosol spray cans for separating the soapy film from a bubble blowing ring and/or complex mechanical arrangements for moving such a ring into and out of a reservoir containing the bubble blowing solution.

Typical of such exemplary prior art patents relating to relatively simple bubble blowing devices are U.S. Pat. Nos.: 1,115,556-Little [a tubular cone having a mouthpiece at its apicad end, an internal damper, and a frusto-conical sleeve formed of liquid absorbent material at its large end]; 1,576,287-Larsen [a specially shaped mouthpiece for blowing bubbles]; 1,646,398-Gaffin and 2,711,051-Pick [tubular or conical bubble pipes having outwardly flared prongs at one end of the pipe for holding bubble forming solution]; 2,514,009-Raspet, 3,109,255-Hein, 3,950,887-Kort and 4,447,982-Gushea [bubble blowing devices including rings having specially shaped surfaces for holding films of bubble blowing solution]; 3,443,337-Ehrlich [a bubble pipe having a mouthpiece at one end and a membrane of flexible absorbent material stretched across its opposite end]; and, 3,952,447-Hackell [a bubble blowing device including an annular open topped chamber covered by a radially slotted disc for holding a film of bubble forming solution together with provision for separating the soapy film by blowing air therethrough]. Additionally, Swiss Pat. No. 276,744, issued Apr. 1, 1952, to Hein discloses a bubble blowing toy employing a ring-type device for holding a soapy film; while U.K. Pat. No. 1,509,848 published May 4, 1978, discloses an electromotive bubble projector or gun having a notched tube at its discharge end for holding a film of bubble forming solution.

Other prior art patents of incidental interest, but which do not relate to bubble blowing devices, per se, include U.S. Pat. Nos.: 1,617,569-Boyle [a shaving brush having a hollow handle adapted to be coupled to a faucet]; 2,582,552-Marco [a toothbrush having bristle cleaning apertures]; 2,825,080-Bongiovanni [a combination brush and powder dispenser]; 3,589,822-Manuel [a disposable toothbrush]; 4,252,455-de la Pena [a shaving brush adapted to be removably attached to an aerosol can of shaving cream]; and, 4,447,169-Vartoughian [an applicator bottle including a brush attached to the discharge nozzle].

The foregoing exemplary prior art patents apparently represented the then-existing state-of-the-art at the time when John D. Cuccio developed a rather unique brush-type soap gathering and bubble blowing device of the type disclosed and claimed in his aforesaid "related" U.S. Pat. No. 4,770,649 issued Sept. 13, 1988. Thus, the Cuccio device employs a hollow, open-ended, tube or ring-shaped base member having a plurality of closely spaced bristles formed of plastic and oriented in an annular array secured in end-to-end relation with, and comprising an axial extension of, the hollow tubular base member. Cuccio points out that the annular array of bristles can be dipped into a reservoir of soapy bubble forming solution which is drawn up between the bristles by capillary action and retained therebetween until such time as the user blows through the hollow base member, thereby separating a film of soapy bubble forming solution from the bristles and forming a series of bubbles at the remote free ends of the bristles.

While the Cuccio device has proven to be operable and, to a limited extent, successful, at the same time one of the principal claimed advantages of Cuccio's bubble blowing device has, in actuality, proven to be highly disadvantageous. Thus, Cuccio states:

". . . The bristle members (which are stated to be preferably formed of resilient plastic material) may also, if so desired, be flexed or bent as shown in FIG. 3. This action has two advantages. One is to pick up all of the soap solution from the bottom wall of vessel 50— this not only results in full use of the soap solution but provides the convenience of an empty vessel when the bubble blowing is over. A second advantage of flexing the bristle members is that it varies the spaces 35 between bristle members, thus enabling the capillary action to be varied accordingly." (Col. 3, lines 30–39; See, also, Col. 3, lines 5 and 6)

However, it has now been found that in use, bending of the bristles, particularly when formed of resilient plastic material, is highly disadvantageous because such bending serves to permanently distort the bristles, causing the gaps between adjacent bristles to enlarge to a point where the soapy fluid is not effectively drawn up between the bristles by capillary action and/or is not retained therebetween, thus preventing formation of the continuous films of soapy solution that are necessary to reliably generate bubbles. And, of course, since such devices are principally intended for use by young children, it has been found that the extremely rough usage to which the devices are subjected serves to rapidly destroy the efficacy of the system. Indeed, it has now been found to be highly undesirable to permit flexure of the bristles and highly desirable to insure that the bristles are essentially protected and prevented from engaging any solid surface which can cause bristle flexure and consequent damage of the bristles.

SUMMARY OF THE INVENTION

The present invention overcomes the foregoing disadvantages inherent in Cuccio U.S. Pat. No. 4,770,649 and in the remaining known prior art cited above while, at the same time: i) retaining the advantageous features of the Cuccio device; i) substantially improving upon the capacity of brushes of any given size to absorb fluid through capillary action and to retain quantities of such absorbed fluid significantly greater than heretofore possible; and iii), providing a children's bubble blowing system which is not only highly effective, but, additionally, highly resistant to damage and resistant to loss of unused bubble forming solution resulting from inadvertent tipping over of the reservoir for the solution.

More specifically, in one of its important aspects, the present invention makes advantageous use of a hollow rigid sleeve which is secured to the hollow base member in end-to-end coaxial relation therewith and which is in surrounding relation to the annular array of bristles while being closely spaced therefrom and dimensioned such that the free bristle ends project slightly beyond the free end of the sleeve. Thus, the rigid sleeve serves to protect the bristles and prevent flexure or deformation thereof, while maintaining the bristles in the desired closely spaced, axially extending, annular orientation at all times—i.e., when the bristles are being loaded and when the user is blowing bubbles from the soapy film retained thereon. Additionally, since the sleeve surrounds and is closely spaced from the bristles over a major portion of their effective axial length, it has been found that when the bristles are loaded with fluid by dipping the projecting free bristle ends into a fluid body, excess fluid is absorbed by capillary action and retained in the annular space between the inner surface of the sleeve and the outermost bristles of the annular bristle array most proximate thereto.

In accordance with another of the important aspects of the invention, it has been found that the cross sectional configuration of each bristle can be designed such that the surface area of each bristle is increased and, at the same time, the volume of space between adjacent bristles available to hold fluid drawn therebetween by capillary action is significantly increased without detracting from the bristles' ability to draw fluid out of a fluid reservoir through capillary action. To this end, bristles made in accordance with the present invention include a plurality of longitudinally extending radial flutes.

In a related aspect of the invention, it has been found that where the bristles—which are generally linear —are shaped to have a slightly sinuous configuration defined by random undulations deviating slightly from the axis of each bristle, the random undulations between each group of adjacent, generally parallel, bristles serve to randomly increase the inter-bristle gaps, thereby increasing the fluid absorption and retention capacity of a brush employing such sinuous bristles. Of course, it will be understood by those skilled in the art that while adjacent bristles in a brush's bristle array will be generally parallel when considered from an overall end-to-end standpoint, the random undulations present intermediate the bristle ends will insure that the bristles are not truly parallel throughout their lengths, but, rather, the gaps therebetween will vary slightly; and, it is in this sense that the bristles have been described herein and in the appended claims as "generally parallel".

Finally, when the invention is incorporated in a bubble blowing system of the type employed by young children, thus leading to the chance—indeed, probability—that the container for the bubble blowing solution will be inadvertently overturned, the invention contemplates usage of a specially designed reservoir which, because of its configuration: i) assures that the bristles of bubble blowing brushes made in accordance with the invention are prevented from flexure and consequent damage even when the child misuses the brush; and ii), prevents spillage of the bubble blowing solution even in those instances where the child inadvertently overturns the container or reservoir of bubble blowing solution.

DESCRIPTION OF THE DRAWINGS

These and other objects and advantages of the present invention will become more readily apparent upon reading the following Detailed Description and upon reference to the attached drawing, in which.

Figure 1:
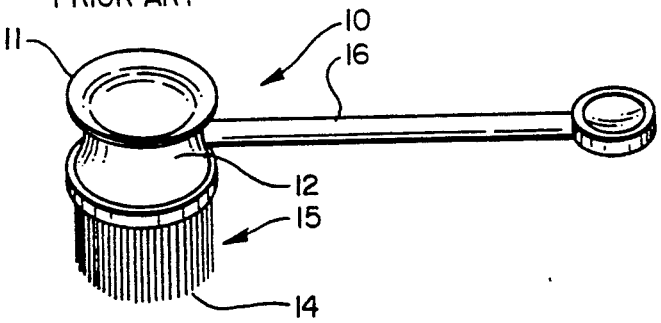
FIG. 1 PRIOR ART
FIG. 1 is an isometric view here depicting a conventional prior art brush-type bubble blowing device of the type disclosed in the aforesaid Cuccio U.S. Pat. No. 4,770,649.

While the invention is susceptible of various modifications and alternative forms, specific embodiments thereof have been shown by way of example in the drawing and will herein be described in detail. It should be understood, however, that it is not intended to limit the invention to the particular forms disclosed but, on the contrary, the intention is to cover all modifications, equivalents and/or alternatives falling within the spirit and scope of the invention as expressed in the appended claims.

DETAILED DESCRIPTION

Turning now to the drawings, and directing attention first to FIG. 1, there has been illustrated a conventional prior art bubble blowing device, generally indicated at 10, of the type disclosed in the aforesaid U.S. Pat. No. 4,770,649 issued to John D. Cuccio. As here shown, the device 10 includes an open ended, hollow, tubular body member 11 having a constricted venturi-like neck 12. A plurality of bristles 14, preferably formed of any suitable, flexible plastic material, are disposed in a hollow annular array, generally indicated at 15, with one end of each bristle (the upper end as viewed in FIG. 1) secured in end-to-end relation to one end of the hollow tubular body member 11 (e.g., the lower end of body member 11 as viewed in FIG. 1); and, with the annular bristle array 15 comprising an axial extension of the hollow body member 11. If desired, a handle 16 can be secured to the body member 11 for facilitating manipulation of the bubble blowing device 10.

Thus, the arrangement is such that the user can grasp the device 10 by using handle 16 and dip the bristle array 15 into a suitable container or reservoir (not shown) of soapy water or other suitable bubble forming solution. As a consequence, the bubble forming solution is drawn up between adjacent bristles 14 by virtue of capillary action, with the fluid being retained between adjacent bristles 14 by surface tension until usage of the device. In order to form bubbles, the user need only blow through the hollow tubular body member 11, or otherwise direct a moving air stream therethrough, thus separating a film of bubble forming solution from the bristles 14 and producing one or more bubbles.

According to the patentee, Cuccio, one of the alleged advantageous features of his device 10 resides n the fact that the user can, when loading the device with bubble forming solution, engage the flexible bristles with the bottom and/or sidewall of the container of solution and flex the bristles 14, thereby varying the spacing between adjacent bristles and allegedly enhancing capillary attraction of the solution. Unfortunately, however, it has now been determined that such flexure of the bristles 14, particularly when done repeatedly, causes permanent deformation of the bristles—in some instances, increasing the inter-bristle spacing to such an extent that the soapy solution can no longer be attracted by capillary action and is not retained between adjacent bristles by surface tension. This is a particularly vexing problem since bubble blowing devices 10 of the type here described are generally used by children who subject such devices to extremely rough treatment, with the consequent permanent deformation of the bristles 14 serving to destroy the ability of the device to establish a uniform, continuous, uninterrupted film of soapy solution which can be separated from the bristles 14 by a moving air stream to form the desired bubbles.

Figure 2:
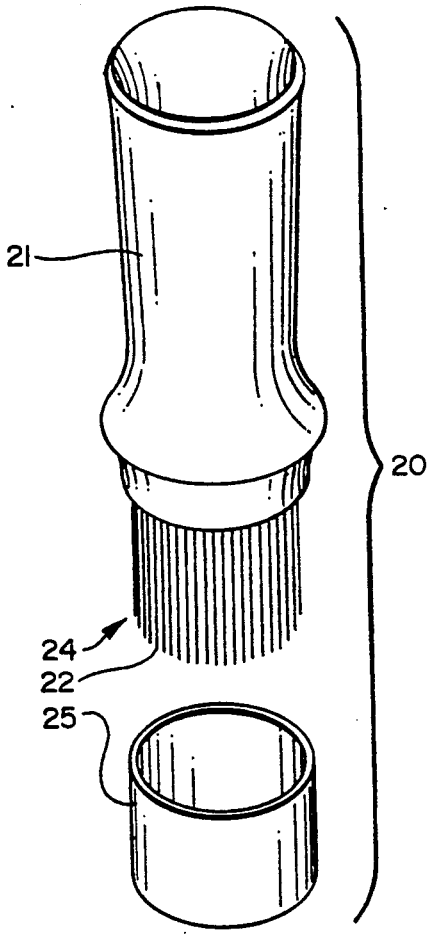
FIG. 2 is a partially exploded isometric view of and exemplary brush—here an exemplary bubble blowing brush-embodying features of the present invention.
Figure 3:
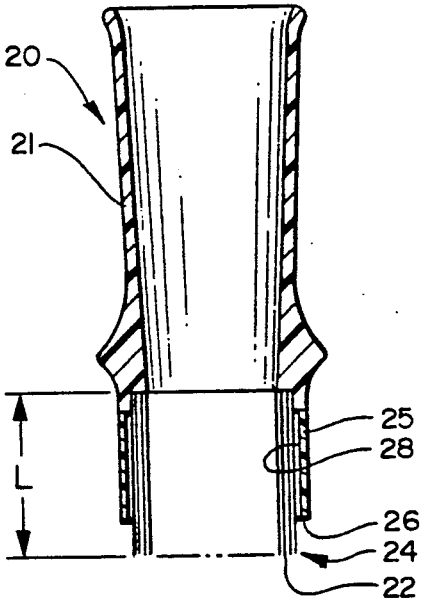
FIG. 3 is a vertical sectional view of the exemplary bubble blowing brush shown in FIG. 2, here depicting the spatial relationship between, and the relative positions of, the three (3) basic components of the brush—viz., the hollow base member or handle, the annular array of bristles, and the hollow protective sleeve surrounding the bristles.

In accordance with one of the important aspects of the present invention, provision is made for minimizing—indeed, to the extent possible, eliminating—the possibility of bristle deformation by designing the brush in such a manner that the bristles 14 are essentially protected and shielded from contact with rigid surfaces such, for example, as the bottom and/or side wall of a fluid reservoir. To accomplish this, and as will be best appreciated by reference to FIGS. 2 and 3 conjointly, an exemplary bubble blowing device or brush embodying features of the present invention has been generally indicated at 20. As here shown, the exemplary brush 20 includes an elongate, open-ended, hollow, tubular body member 21 having a plurality of closely spaced, side-by-side, generally parallel bristles 22 disposed in a hollow, tubular or annular array, generally indicated at 24, and fixedly secured in co-axial end-to-end relation to the hollow tubular body member 21 in any suitable manner such, merely by way of example, as by embedding one end of the bristles in the body member 21 or with a suitable adhesive (not shown). In carrying out this aspect of the invention, an open-ended, hollow, tubular, rigid sleeve 25 having an external diameter approximately equal to the external diameter of the end of body member 21 to which the bristles 22 are secured and an internal diameter slightly greater than the external diameter of the annular bristle array 24, is fixedly secured to the body member 21 in co-axial end-to-end relation therewith and in closely spaced surrounding relation to the bristles 14. As will become most clear upon inspection of FIG. 3, the bristles 22 are of generally equal length having an axial length "L", while the sleeve 25 has an axial length somewhat shorter than that of the bristles 22, thereby permitting the free ends of the bristles 22 to project slightly beyond the free end 26 of the sleeve 25.

As a consequence of the foregoing construction, the bristles 22 are precluded from engagement with rigid unyielding surfaces such as the bottom and/or sidewall of a fluid container or reservoir, thereby minimizing the risk of bristle flexure and preventing deformation of the bristles 22. Such an arrangement ensures that the side-by-side bristles 22, although flexible, remain in their generally parallel closely spaced configuration defining essentially fixed inter-bristle spacings permitting attraction of fluid by capillary action and retention of the attracted fluid by adjacent bristles 22 through surface tension. At the same time, the sleeve 25, being closely spaced from and in substantially surrounding relation to the annular bristle array 24 throughout a major portion of the axial length of the bristle array 24, not only serves to protect the bristles but, additionally, the annular space 28 between the sleeve 25 and the bristle array 24 defines an internal reservoir where excess soapy fluid attracted by capillary action is permitted to reside and is retained therein by surface tension.

Figure 4:
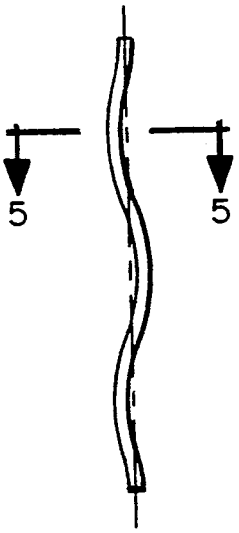
FIG. 4 is an enlarged, vertical elevational view of a single bristle employed with the exemplary brush, here illustrating in somewhat exaggerated form the slightly sinuous construction of a typical bristle defining slight random undulations along the bristle's axial length so as to enhance the fluid retention characteristics of a brush employing a plurality of such bristles in a closely spaced array.

In accordance with another of the important aspects of the present invention, provision is made for preshaping the bristles 22 so as to maximize the internal volume of space defined by the inter-bristle spaces and thereby to increase the quantity of fluid that can be attracted by capillary action and retained by surface tension. To accomplish this, it has been found that where the bristles 22 are pre-shaped to be slightly sinuous, as shown in FIG. 4, the configuration is such that each bristle 22 includes a random array of undulations. As a consequence, when a plurality of sinuous bristles 22 are placed in side-by-side orientation—for example, in an annular array such as shown at 24 in FIGS. 2 and 3—the random undulations in the bristles 22 cause varied spacing between adjacent bristles which increases the fluid retention characteristics of the array of bristles 22. However, because the sinuous configuration of the bristles 22 is a designed characteristic—as contrasted with random, permanent, bristle deformation resulting from rough usage and excessive bristle flexure—it is possible to control the undulations so that fluid attraction by capillary action is not denigrated, while at the same time, the fluid retention characteristics of the bristles 22 defined by: i) inter-bristle spacing; and ii), the annular space 28 between the bristle array 24 and the sleeve 25, is significantly enhanced.

Figure 5:
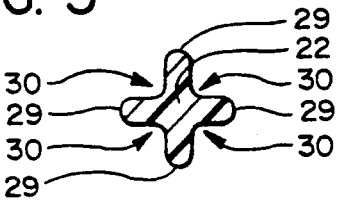
FIG. 5 is a transverse sectional view here taken substantially along the line 5—5 in FIG. 4 and depicting an exemplary cross sectional configuration for the bristles which has been found to significantly enhance the fluid attracting and retention characteristics of the brush; and, FIG. 6 is a side elevational view of an overall bubble blowing system made in accordance with the present invention here employing a brush of the exemplary type depicted in FIGS. 2 and 3 and an essentially spillproof reservoir, here shown in section.

In furtherance of this aspect of the invention, it has been found that the cross-sectional configuration of the bristles can also be controlled so as to maximize the surface area of any given bristle, thereby maximizing the quantity of fluid that can be retained by surface tension between adjacent bristles. To accomplish this, and as best illustrated in FIG. 5, the exemplary bristles 22 are preferably formed with a plurality of longitudinally extending radial ribs 29—there being four (4) such ribs depicted in FIG. 5—defining longitudinally extending flutes therebetween, generally indicated at 30. Thus, it will be apparent that the surface area of the exemplary bristle 22 shown in FIG. 5, is significantly increased when contrasted with conventional, rounded, rod-like bristles, thereby increasing the capacity of the bristles to retain fluid adhering thereto through surface tension.

Figure 6:
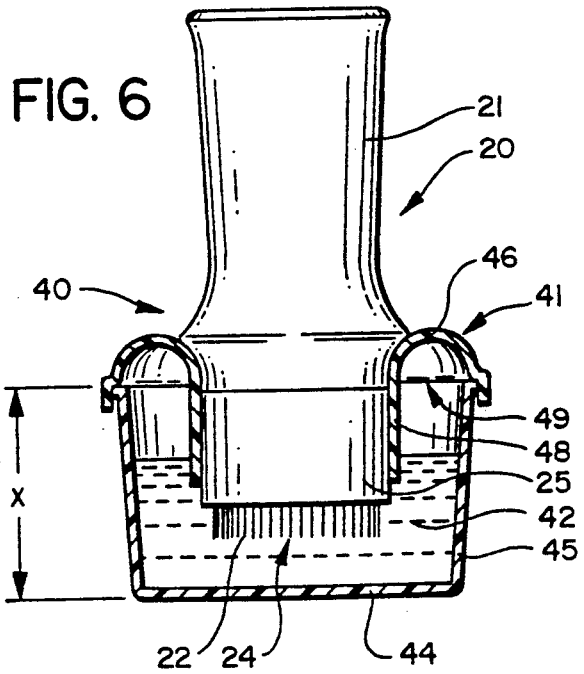

Turning now to FIG. 6, there has been illustrated an overall bubble blowing system, generally indicated at 40, employing: i) a bubble blowing brush 20 of the type hereinabove described in connection with FIGS. 2 through 5; and ii), a specially designed receptacle, generally indicated at 41, defining an essentially spill-proof reservoir for holding a bubble forming fluid solution 42. Thus, as here shown, the receptacle 41 includes a generally flat base portion 44 and an integral, continuous, upstanding outer sidewall 45 having a height "x" (where "x" is greater than the length "L" of the bristles 22). In carrying out this aspect of the invention, the outer sidewall 45 terminates at its upper end in an inturned flange 46, with such flange 46 terminating at its inner end in a continuous downwardly extending, inner sidewall 48 generally parallel to the outer sidewall 45, but spaced inwardly therefrom and having a height less than the height "x" of the outer sidewall 45. Thus, the arrangement is such that the outer sidewall 45, flange 46 and inner sidewall 48 define an inverted annular trough, generally indicated at 49, for containing and trapping the bubble forming fluid solution 42 when the receptacle 41 is inadvertently tipped over.

In carrying out the invention, the inner portion of the flange 46 and the inner sidewall 48 of receptacle 41 are preferably shaped complementary to the exterior configuration of the lower end of the hollow tubular body member 21 on brush 20 and the co-axial integral sleeve 25 secured thereto so that the flange 46 and innerside wall 48 define a seat for the bubble blowing brush 20 which enables the user to dip the free projecting ends of the bristles 22 into the bubble forming solution 42 while at the same time preventing the bristles 22 from contacting, and therefore from being flexed or otherwise distorted by, the bottom wall 44 and/or outer and inner sidewalls 45, 48 of the receptacle 41 during usage.

Those skilled in the art will appreciate from the foregoing description that there has hereinabove been described an exemplary bubble blowing system 40, including a bubble blowing brush 20, which retains all of the advantages of the device described in the aforesaid U.S. Pat. No. 4,770,649 to Cuccio; while, at the same time, eliminating the disadvantageous features thereof by insuring that the flexible bristles 22 are protected and precluded from permanent deformation resulting from undesired flexure of the bristles 22 during loading of fluid into the brush. When used as part of a bubble blowing system, the bristle end of the exemplary device 20 is configured to mate with, and be seated in, a fluid receptacle having an inverted trough-shaped upper end, thereby further precluding risk of undue deformation of the bristles 22 while, at the same time; essentially eliminating the risk of loss of the fluid in the reservoir when the user—normally a child—inadvertently tips the receptacle 41 over.

Those skilled in the art will further appreciate that the use of sinuous bristles and/or fluted bristles significantly enhances the fluid attraction and retention characteristics of the brush, whether used as a bubble blowing device or for some other purpose. Similarly, the presence of a sleeve closely surrounding the major axial extent of the bristles while leaving the free ends of the bristles projecting slightly beyond the free end of the sleeve not only serves to protect the bristles from undue flexure and deformation, but, moreover, increases the fluid holding capacity of the brush 20 by providing an integral internal reservoir 28 in the brush 20.

I claim:

1. A brush for attracting and retaining high volumes of bubble-forming solution and for permitting said retained bubble-forming solution to be separated therefrom by an air stream blown through said brush to form a plurality of bubbles, said brush comprising, in combination:

(a) a base member comprising an elongate, hollow, open-ended, generally tubular member whose cross-sectional configuration defines an endless wall;

(b) a plurality of closely spaced, generally parallel, flexible bristles of substantially equal length secured at one end to said base member and projecting therefrom in a hollow tubular array of substantially constant external diameter and comprising a coaxial extension of said tubular base member, said bristles having their free ends terminating in a common first plane substantially normal to said bristles and spaced from said base member; and, c) a hollow tubular sleeve having an inside diameter greater than said substantially constant external diameter of said hollow tubular array of bristles, said hollow tubular sleeve having one end secured to said base member and its opposite free end spaced from said base member and terminating in a second plane substantially parallel to said first plane and intermediate said base member and said first plane so that said free ends of said bristles project slightly beyond said free end of said sleeve, said sleeve substantially surrounding the portions of said bristles proximate to said base member and being slightly spaced from said bristles throughout the entire length of said sleeve;

whereby, when the free ends of said bristles projecting beyond said free end of said sleeve are dipped into a fluid body of bubble-forming solution, the bubble-forming solution is drawn upwardly between said bristles by capillary action and is retained therein and in the region between the inner surface of said sleeve and the outermost ones of said bristles most proximate to said sleeve, and whereby an air stream projected axially through said tubular base member, said tubular bristle array and said tubular sleeve serves to separate at least a portion of the bubble-forming solution retained by said bristles from said bristles so as to permit formation and projection of a plurality of bubbles.

2. A brush as set forth in claim 1 wherein each of said bristles is provided with a plurality of longitudinally extending, parallel, radial flutes extending the entire length of each bristle so as to increase the surface are of each bristle.

3. A brush as set forth in claims 1 or 2 wherein each of said plurality of closely spaced, generally parallel flexible bristles is slightly sinuous, defining random undulations along the axial lengths thereof.

* * * * *